US006502868B1

(12) United States Patent
Laspa et al.

(10) Patent No.: US 6,502,868 B1
(45) Date of Patent: Jan. 7, 2003

(54) DUAL T-LOCK APPARATUS

(75) Inventors: Tevis Dean Laspa, Ridgefield, WA (US); Harold John Newhouse, Vancouver, WA (US); Ted Eugene Slanker, Vancouver, WA (US)

(73) Assignee: Protech Industries, Inc., Vancouver, WA (US)

( * ) Notice: Subject to any disclaimer, the term of this patent is extended or adjusted under 35 U.S.C. 154(b) by 65 days.

(21) Appl. No.: 09/653,927

(22) Filed: Sep. 1, 2000

(51) Int. Cl.[7] ..... E05C 9/16
(52) U.S. Cl. ..... 292/26; 292/11; 292/48
(58) Field of Search ..... 292/11, 24, 26, 292/29, 44–48, 52, 53, 56

(56) References Cited

U.S. PATENT DOCUMENTS

| | | | | | |
|---|---|---|---|---|---|
| 2,992,031 | A | * | 7/1961 | Krause et al. | |
| 3,026,131 | A | * | 3/1962 | Krause | |
| 3,578,368 | A | * | 5/1971 | Dupuis | 292/45 |
| 4,273,368 | A | | 6/1981 | Tanaka | |
| 4,488,669 | A | | 12/1984 | Waters | |
| 4,635,992 | A | | 1/1987 | Hamilton et al. | |
| 4,674,665 | A | | 6/1987 | Van Kirk | |
| 4,706,478 | A | | 11/1987 | Swan et al. | |
| 4,728,017 | A | | 3/1988 | Mullican | |
| 4,784,414 | A | * | 11/1988 | Free | 292/52 |
| 4,848,626 | A | | 7/1989 | Waters | |
| 4,878,706 | A | | 11/1989 | Novikov | |
| 4,946,215 | A | | 8/1990 | Taylor | |
| 4,967,944 | A | | 11/1990 | Waters | |
| 4,998,425 | A | | 3/1991 | Hoogland | |
| 5,042,853 | A | * | 8/1991 | Gleason et al. | 292/126 |
| 5,235,830 | A | | 8/1993 | Benge | |
| 5,308,126 | A | * | 5/1994 | Weger, Jr. et al. | 292/53 |
| 5,484,092 | A | | 1/1996 | Cheney | |
| 5,526,660 | A | | 6/1996 | Bennett et al. | |
| 5,595,076 | A | | 1/1997 | Weinerman et al. | |
| 5,601,206 | A | | 2/1997 | Haas et al. | |
| 5,875,948 | A | | 3/1999 | Sadler | |
| 5,984,383 | A | | 11/1999 | Parikh et al. | |
| 6,079,585 | A | * | 6/2000 | Lentini | 220/324 |
| 6,334,560 | B1 | * | 1/2002 | Lentini | 224/404 |

* cited by examiner

*Primary Examiner*—Robert J. Sandy
*Assistant Examiner*—André L. Jackson
(74) *Attorney, Agent, or Firm*—Kurt M. Rylander

(57) ABSTRACT

A Dual T-Lock Apparatus for T-handle latch assemblies mountable on toolboxes is a transverse lock rod connecting two T-handle latch assemblies and apparatus mounted on each T-handle latch assembly such that one latch assembly can be released, automatically releasing, through the transverse lock rod, the other latch assembly. A Dual T-Lock comprises two T-handle latch assemblies provided with the Dual T-Lock Apparatus. A toolbox is provided that fitted with a Dual T-Lock and suitable for use in a truck. A toolbox is provided that is fitted with T-handle latch assemblies fitted with a Dual T-Lock Apparatus.

17 Claims, 5 Drawing Sheets

DUAL T-LOCK APPARATUS

FIELD OF THE INVENTION

The instant invention relates to latch assemblies and locks on containers and particularly to truck toolbox T-handle latch assemblies and locks.

BACKGROUND

In a number of fields, such as construction, where it is necessary for a worker driving to a job site to carry with him a large number of different tools and/or certain types of parts for which he may find frequent need in performing his work, such tools and/or parts are ordinarily kept in some type of box or chest.

Existing toolbox latch assemblies consist primarily of four different styles of operation: Paddle, T-handle, D-handle, and Pushbutton. Each of these works in a standalone operation. Each of these can be provided with secure locking means. The T-handle and D-handle are the sturdiest of the four. Lock manufacturers have devised methods to manufacture Paddle and Pushbutton assemblies into effective dual control operation, but have not done the same for T-handle and D-handle assemblies. Using two commercially available T-handle assemblies in a single lid box does not allow one handle to be unlatched and to open the box. To securely close a single lid truck box, the length of the lid requires that two latching mechanisms be spaced apart along the front of the box. Similarly, split lid and gull wing toolboxes can have a latching mechanism mounted on each opposite end to close each separate lid. However, the user cannot access each latching mechanism simultaneously. Instead, the user is inconvenienced by having to walk around the truck and separately open each lid from the opposite end of the box. This placement on a single lid box and a split lid or gull wing box adds extra work to the operator of T-handle latch assembly as that person must go to both sides of the vehicle to unlock and open the two T-handle latches.

The following represents a list of known related art:

U.S. Pat. No. 4,878,706, issued to Novikov, Nov. 7, 1989;

U.S. Pat. No. 5,595,076, issued to Weinerman, et al, Jan. 21, 1997;

U.S. Pat. No. 4,946,215, issued to Taylor, Aug. 7, 1990

U.S. Pat. No. 4,998,425, issued to Hoogland, Mar. 21, 1991;

U.S. Pat. No. 5,601,206, issued to Haas, et al., Feb. 11, 1997;

U.S. Pat. No. 5,875,948, issued to Sadler, Mar. 2, 1999;

U.S. Pat. No. 4,488,669, issued to Waters, Dec. 18, 1984;

U.S. Pat. No. 5,484,092, issued to Cheney, Jan. 16, 1996;

U.S. Pat. No. 5,984,383, issued to Parikh, et al., Nov. 16, 1999;

U.S. Pat. No. 5,526,660, issued to Bennett, et al., Jun. 18, 1996;

U.S. Pat. No. 4,706,478, issued to Swan, et al., Nov. 17, 1987;

U.S. Pat. No. 4,848,626, issued to Waters, Jul. 18, 1989;

U.S. Pat. No. 4,674,665, issued to Van Kirk, Jun. 23, 1987;

U.S. Pat. No. 4,728,017, issued to Mullican, Mar. 1, 1988; and

U.S. Pat. No. 4,635,992, issued to Hamilton, et al., Jan. 13, 1987.

The teachings of each of the above-listed citations (which does not itself incorporate essential material by reference) are herein incorporated by reference. None of the above inventions and patents, taken either singularly or in combination, is seen to describe the instant invention as claimed. Thus solving the aforementioned problems is desired.

Heretofore, a Dual T-Lock Apparatus for modifying two T-handle latch assemblies to work in tandem has never been performed. An article and method for joining together two T-handle latch assemblies such that both T-handle latch assemblies can be released by opening only one of either of the T-handle latch assemblies has not previously been provided. And article and method for joining together two T-handle latch assemblies, each latch assembly provided with a keyed lock cylinder, such that both T-handle latch assemblies can be released by unlocking and opening only one of either of the T-handle latch assemblies has not previously been provided. A toolbox fitted with two T-handle latch assemblies where both T-handle latch assemblies can be released by unlocking and opening only one of either of the T-handle latch assemblies has not previously been provided.

Therefore, it is highly desirable to create a Dual T-Lock Apparatus for modification of T-handle latch assemblies such that the T-handle latch assemblies will work in tandem in such a way that where both T-handles are closed, both can be released by opening only one. It is highly desirable to create Dual T-Lock comprised of two T-handle latch assemblies provided with the Dual T-Lock Apparatus such that the two T-handle latch assemblies work together in such a way that where both are closed and locked, both can be released by unlocking and opening only one. It is highly desirable to provide a toolbox fitted with a Dual T-Lock where the two T-handle latch assemblies are mounted on the toolbox at a distance from each other, for purposes of securely closing toolbox lid or lids, wherein the two T-handle latch assemblies work together such that when the toolbox lid is closed and secured by closing the T-handle latch assemblies, the lid can be opened by opening either T-handle latch assembly, which will drive and release the other T-handle latch assembly, thus freeing the toolbox lid to be opened. It is highly desirable to provide a toolbox fitted with a locking Dual T-Lock comprised of two T-handle latch assemblies with locking assemblies mounted on the toolbox at a distance from each other, for purposes of closing and securely locking the toolbox lid, wherein the two T-handle latch assemblies work together such that when the toolbox lid is closed and locked by closing and locking the T-handle latch assemblies, the lid can be opened by unlocking and releasing either T-handle latch assembly, which will drive and open the other T-handle latch assembly, thus freeing the toolbox lid to be opened.

Potential customers for articles and methods that meet these objects include toolbox and truck box manufacturers, lock manufactures, truck owners, toolbox and truck box owners, construction industry workers, professional contractors, and many more.

OBJECTS AND SUMMARY

Accordingly, it is an object to provide novel articles and methods for solving the above-mentioned problems. In particular, it is an object to provide a Dual T-Lock Apparatus for modifying two T-handle latch assemblies to be configured with, receive, and be joined by a transverse lock rod such that, when both T-handle latch assemblies are closed and locked, both T-handle latch assemblies can be opened by unlocking and opening either T-handle latch assembly alone. It is a further object to provide dual action T-lock comprised of two T-handle latch assemblies provided with the Dual T-Lock Apparatus. It is a further object of the present invention to provide a toolbox with a single lid and two T-handle latch assemblies that can both be simultaneously released from a single release accessible from either end of the box. It is a further object of the invention to provide improved elements and arrangements thereof for the purposes described which is inexpensive, dependable and fully effective in accomplishing its intended purposes. These and other objects of the present invention will become readily apparent upon further review of the following specification and drawings.

To achieve the objects and in accordance with the purpose of the invention, as embodied and broadly described herein, a Dual T-Lock Apparatus is provided for modifying T-handle latch assemblies that are mountable on a toolbox. The Dual T-Lock Apparatus modifies a T-handle latch assembly with the addition of a novel dualcam and dualcam pin, and a dual paw. The Dual T-Lock Apparatus connects the T-handle latch assemblies with a transverse lock rod such that both T-handle latch assemblies can be opened by unlocking and opening only one of either of the T-handle latch assemblies. The transverse lock rod can be provided with a biasing spring that connects to the transverse lock rod and to a hole in an internal housing of one of the T-handle latch assemblies. A toolbox is provided configured with two modified T-handle latching assemblies, spaced at a distance from each other, connected by a transverse lock rod, such that both T-handle latch assemblies can be unlocked and opened by unlocking and opening only one of either of the T-handle latch assemblies, thus freeing the secured toolbox lid to be opened.

First and second commercially available T-handle latch assemblies come provided with T-handles, mounting housing with flange and offset pans, key cylinder locking means, internal housing, and a lock shank connected between the mounting housing and the internal housing. In an embodiment of the present invention, first and second T-handle latch assemblies are modified by providing each with a novel dualcam, having an dualcam pin, affixed to a lock shank, a dual paw rotatable about the lock shank wherein the dual paw has a lock hook engageable to a lock loop provided on the lid of toolbox and wherein the dual paw is engageable with the dualcam pin, and wherein the dual paw can be provided with a bushing to ease the rotation about the lock shank. The latch assemblies can further be provided with a plurality of nuts and s, for securing the novel parts to the lock shank. Each of the first and second T-handle latch assemblies are movably connected to a transverse lock rod that enables both T-handle latch assemblies to operate in tandem. The transverse lock rod has a first portion pivotally mounted to the dual paw of the first T-handle latch assembly and a second portion pivotally mounted to the dual paw of the second T-handle latch assembly. The transverse lock rod is thus configured to be pivoted between a closed position and a release position. Each T-handle latch assembly engages its associated lock loop when the transverse lock rod is positioned in the closed position. Each T-handle latch assembly is disposed to release its associated lock loop when the transverse lock rod is positioned in the release position. Moreover, the pivoting of the dual paw of one T-handle latch assembly so as to release its associated lock loop, causes the transverse lock rod to pivot the dual paw of the other T-handle latch assembly so as to disengage the other associated lock loop, thus releasing both T-handle latch assemblies. The transverse lock rod can further be provided with a biasing spring connected to the transverse lock rod and to the internal housing of one of the T-handle latch assemblies.

The Dual T-Lock comprised of two T-handle latch assemblies modified with a Dual T-Lock Apparatus is installed in a toolbox. A toolbox has one end configured to be disposed near the driver side of the truck and another end configured to be disposed near the passenger side of the truck. When a Dual T-lock is mounted on a toolbox, each of a first T-handle latch assembly and a second T-handle latch assembly is configured for selectively securing and releasing the lid relative to the toolbox. One of the T-handle latch assemblies is desirably disposed nearer to the driver side of the truck box and the other closer to the passenger side of the box. The lock hook on a dual paw of each T-handle latch assembly engages a lock loop or a striker mounted to the underside of the lid or lids. The lock hook engages the lock loop in a latched position and releases the lock loop or striker in an unlatched position.

The accompanying drawings, which are incorporated in and constitute a part of this specification, illustrate one embodiment of the invention and, together with the description, serve to explain the principles of the invention.

The novel articles and methods provide a number of advantages. The present invention allows the customer to open his toolbox from one location saving him time and frustration. The present invention allows use of the strongest and sturdiest T-handle latch assembly coupled with the ease in operation form having a latching assemblies operating in tandem. The novel articles and methods of the invention are well suited for use in motor vehicles of all types and in the manufacturing processes for making motor vehicles, and in the after market for repair and upkeep of motor vehicles and motor vehicle engines. The present invention allows the sale of more boxes yielding resulting profitability.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims. Further benefits and advantages of the embodiments of the invention will become apparent from consideration of the following detailed description given with reference to the accompanying drawings, which specify and show preferred embodiments of the present invention.

DETAILED DESCRIPTION

Before beginning a detailed description of the subject invention, mention of the following is in order. When appropriate, like reference materials and characters are used to designate identical, corresponding, or similar components in differing figure drawings. The figure drawings associated with this disclosure typically are not drawn with dimensional accuracy to scale, i.e., such drawings have been drafted with a focus on clarity of viewing and understanding rather than dimensional accuracy. An attempt has been made specifically to point out any dimensions, tolerances, etc., which are important.

Turning now to a discussion of the present invention, a Dual T-Lock Apparatus is provided for T-handle latch assemblies which is adapted for use with a conventional toolbox. A Dual T-Lock Apparatus is also suited for other toolboxes and utility boxes. The present invention also provides a truck toolbox fitted with two T-latch assemblies having a Dual T-Lock Apparatus.

Figure 3:
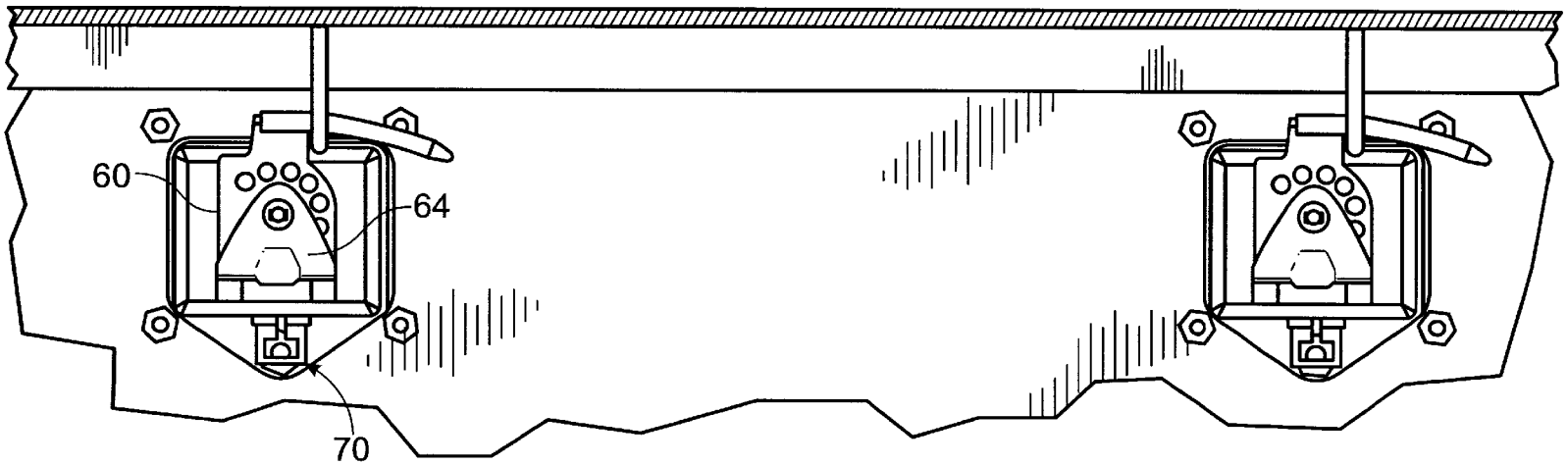
FIG. 3 shows a rear view of a commercially available T-handle latch assembly mounted in a toolbox.

Toolbox mountable T-handle latch assemblies that include lock shanks, mounting housing and internal housings, and which may include lock paws and key cylinder locking means, are well known, see U.S. Pat. No. 4,706,478 (Swan et al) U.S. Pat. No. 5,526,660 (Bennett, et al), and are commercially available. Suitable toolbox mountable T-handle latch assemblies are available under the trade name Recessed Folding "T" Handles, Single Point-8004, from Eberhard Mfg. Company, a division of the Eastern Company, of Cleveland, Ohio and Eberhard Hardware Manufacturing Ltd of Tillsonburg, Ontario, Canada. Those with skill in the art will know that the latch housing can be rectangular, circular, oval, or any of various geometric shapes. The T-handle latch assemblies and methods for mounting on toolboxes other than in terms of the structural combination forming the present invention, is not the Applicants' invention. FIG. 3 displays the inside view of two commercially available T-handle latch assemblies mounted on toolbox.

Figure 5:
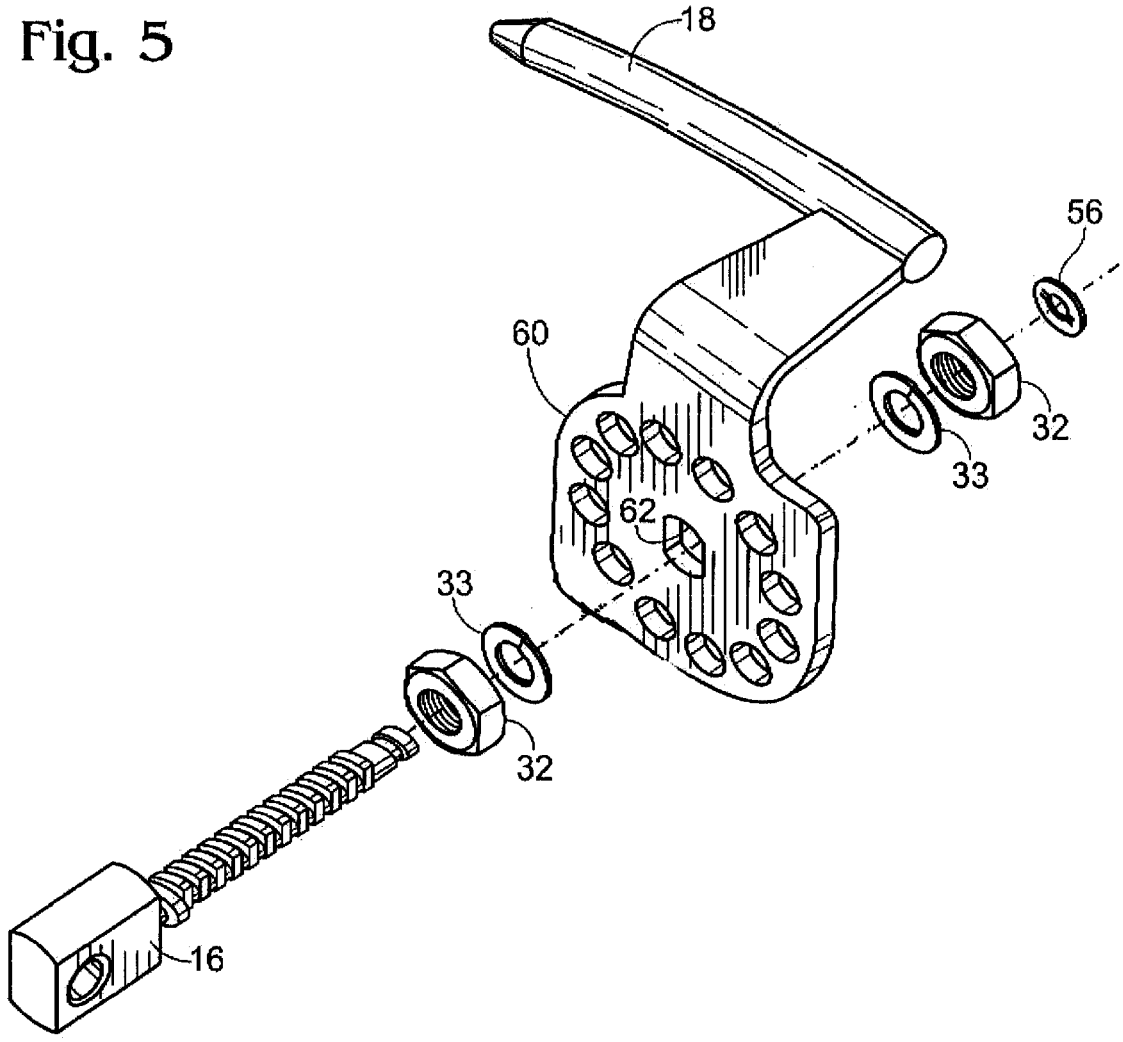
FIG. 5 shows a lock shank of a commercially available T-handle latch assembly, and shows the release apparatus that may normally be provided with a commercially available T-handle latch assembly.

Commercially available T-handle latch assemblies to which the Dual T-Lock Apparatus is applied are provided with a lock shank having an end configured for mounting in the T-handle housing and attaching to the T-handle, having a middle configured with opposed cylindrical threaded faces and opposed parallel flats, configured such that a standard nut of the appropriate size can be screwed thereon, and having an end configured for mounting through a hole in the internal housing. Numerous lock shanks are known in the industry and can generally be seen in U.S. Pat. No. 5,526,660 (Bennett, et al) and U.S. Pat. No. 4,706,478 (Swan et al). The present invention is not limited by the embodiments of the lock shank commercially available so long as the lock shank is mountable between an inner housing and the offset pan of the T-handle housing and is provided through a portion of the lock shank with opposed cylindrical threaded faces and opposed parallel flats. FIG. 5 shows a latch release assembly as commercially provided. In the preferred embodiment of the present invention, a lock shank (16) as shown in FIGS. 5 and 6 is used.

The Dual T-Lock Apparatus of the present invention comprises a transverse lock rod connection apparatus, and two sets of dual T-handle latch assembly apparatus.

Figure 6:
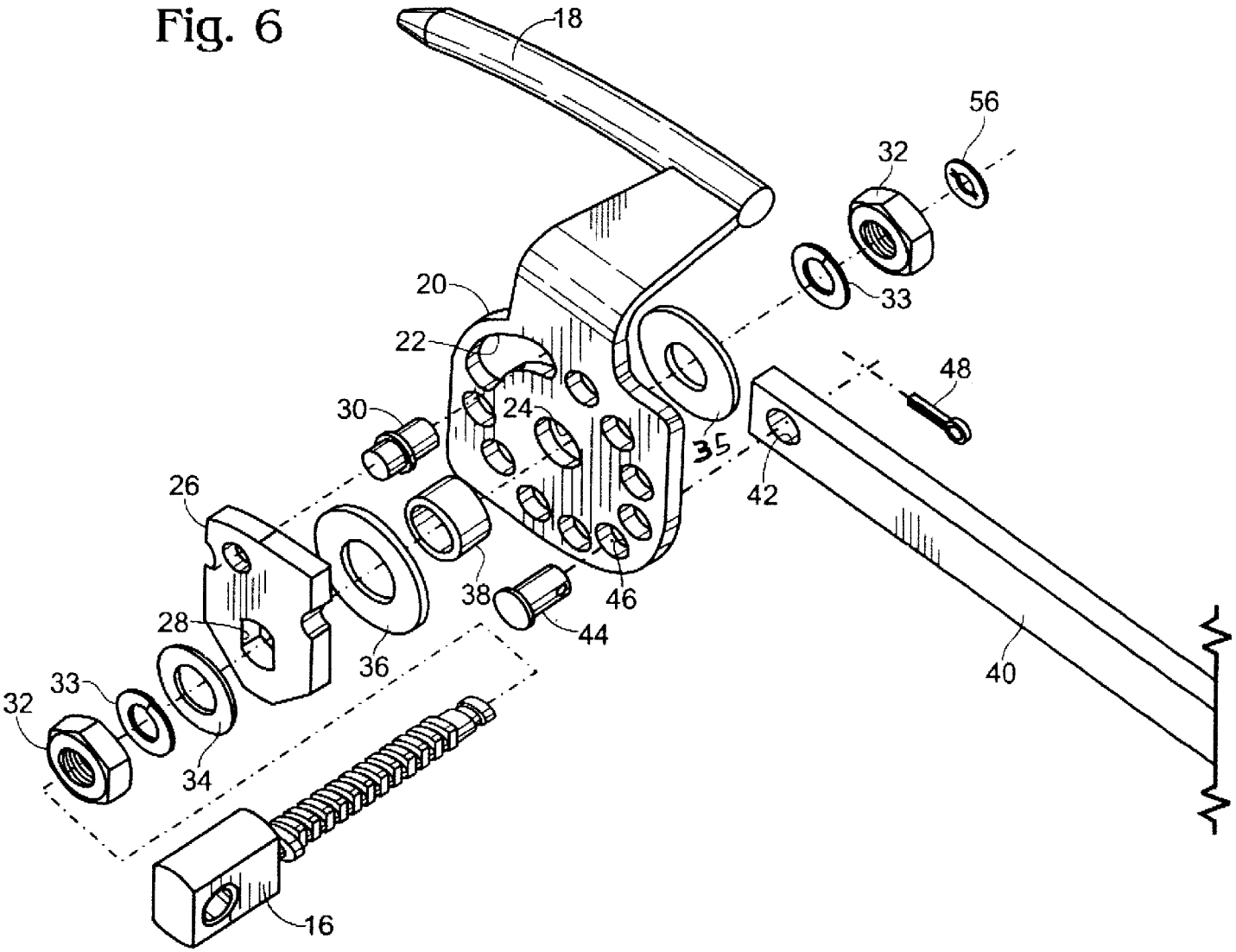
FIG. 6 shows a lock shank of a commercially available T-handle latch assembly, and shows the T-handle latch assembly modification apparatus of an embodiment of the present invention in the order that such T-handle latch assembly modification apparatus would be attached to the lock shank of a T-handle latch assembly.

With reference to FIG. 6, a dual T-handle latch assembly apparatus is mountable on a T-handle latch assembly lock shank (16), and comprises a dual paw (20), a dualcam (26) with a dualcam pin (30) wherein the dualcam pin is movably engageable with the dual paw. In the preferred embodiment, these parts are made of steel, but can be of any metal suitable for toolbox handles and release mechanisms and assemblies, numerous of which are known in the art. The assembly apparatus can further be provided with a dual paw bushing (38), which can be made of plastic. The assembly apparatus can be further provided with a plurality of nuts (32), lock washers (33), washers (35) and dual paw washers (36) for securing the apparatus on the lock shank of a T-handle latch assembly and reducing rubbing generated from the dual paw rotation. In the preferred embodiment, the dual T-handle latch assembly apparatus is additionally provided with, for each T-handle latch assembly, first and second nuts (32) first and second lock washers (33), a washer (35), and a dual paw washer (36). In the preferred embodiment the dual paw washer is an ultra high molecular weight washer preferably of plastic.

Figure 7:
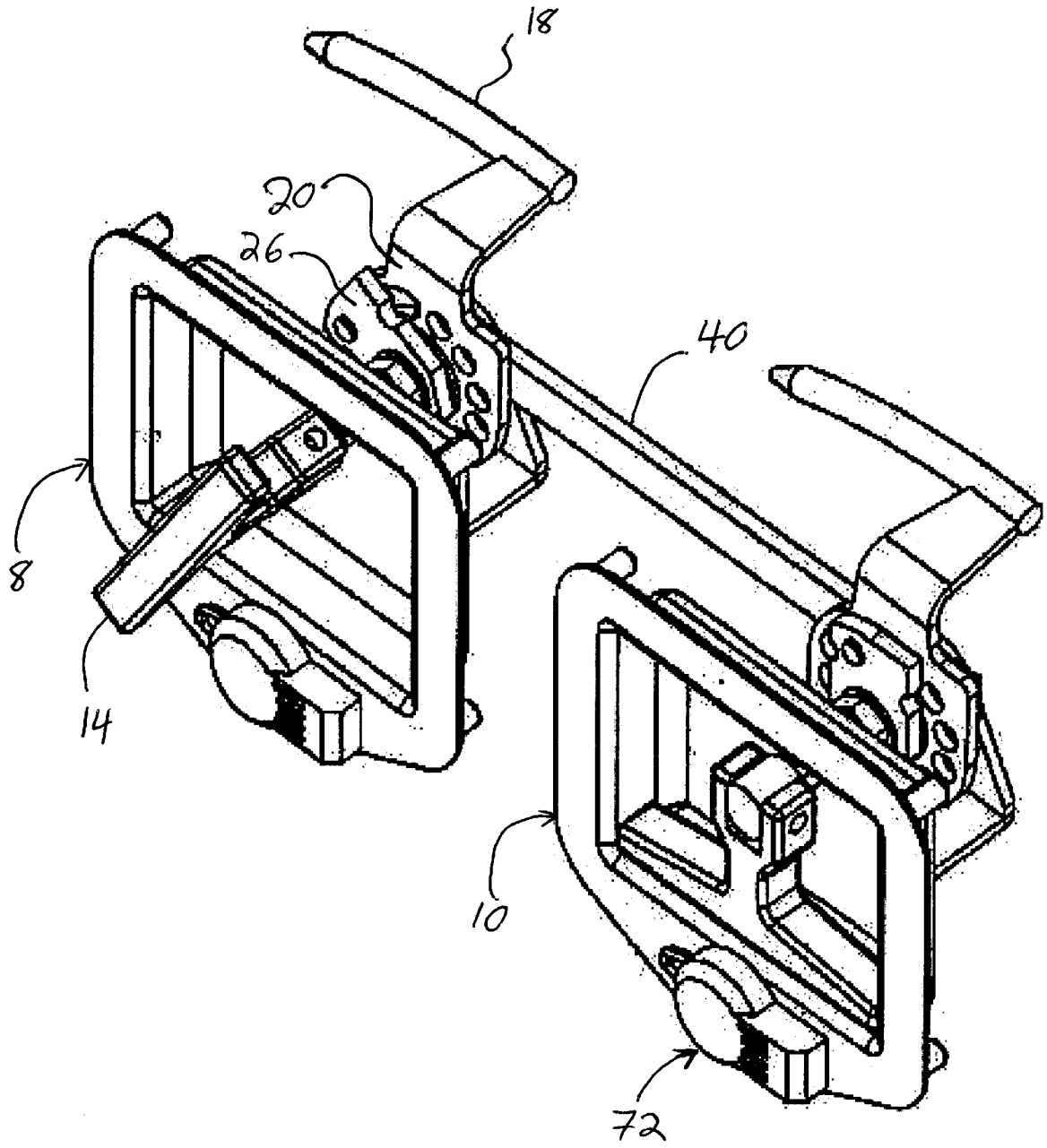
FIG. 7 shows an embodiment of the present invention without a biasing spring.

With reference to FIGS. 6 and 7, a dual paw (20, 21) is provided. The dual paw can be provided with a bushing (38) inserted in the dual paw mounting hole (24). The dual pawis provided with a dualcam pin-engaging slot (22) for engaging a dualcam pin (30) and allowing radial movement of the dualcam pin, wherein when the T-handle latch assembly is assembled the dualcam pin engages within the dualcam pin-engaging slot. The dual paw is also provided with a dual paw hook (18) for engaging a corresponding lock loop (FIGS. 2 and 4 at 12) mounted on the lid of the toolbox. The dual paw is rotatably mounted on a lock shank (16) and can rotate in response to the action of the transverse lock rod (40) without the lock shank being turned. Solely for purposes of understanding the present invention, a lock paw as provided with commercially available T-handle latch assemblies is shown in FIGS. 3 and 5 at 60. In the preferred embodiment of the present invention, a dual paw is made from a commercially available lock paw by rounding the mounting hole in a lock paw (60) to make the dual paw mounting hole (24) so that the dual paw can rotate about the lock shank without the lock shank being turned, and cutting, or alternatively drilling, a dualcam pin-engaging slot (22) in the lock paw.

Referring to FIGS. 6 and 7, a dualcam (26) is provided. The dualcam is attached to threaded portion of a lock shank (16). A dualcam mounting hole (28) has opposed parallel edges and rounded edges to correspond to the cross section of and fit over threaded portions of a lock shank which includes flats which contact opposed parallel edges of the dualcam mounting hole when the lock shank is rotated, to prevent rotation of the dualcam when the lock shank is not turned, and to rotate the dualcam in the direction of rotation of the lock shank when the lock shank is turned. The dualcam is provided with a dualcam pin (30) for engaging the dual paw (20, 21) at the dualcam pin-engaging slot (22). The dualcam pin is passed through the dualcam pin hole and welded to the dualcam.

Figure 4:
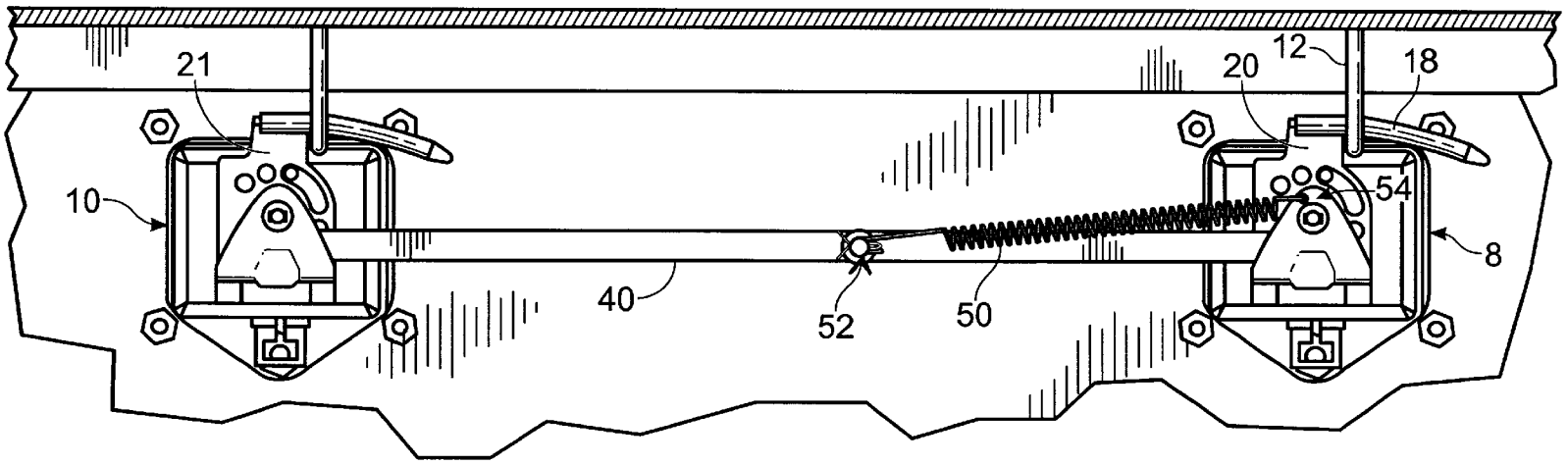
FIG. 4 shows a rear view of the embodiment of the present invention mounted in a toolbox displayed in FIG. 1.

With reference to FIGS. 4, 6, and 7, the transverse lock rod connection apparatus comprises a transverse lock rod (40) and first and second transverse rod pins (44). As shown in FIG. 6, the transverse lock rod is pivotally connected at each end to the first and second dual paw by first and second transverse rod pins. The dual paw on the first T-handle latch assembly is attached to one end of the transverse lock rod for purposes of driving and being driven by the transverse lock rod. The dual paw is attached by passing the transverse rod pin (44) through a hole (42) in the transverse lock rod and a hole (46) in the dual paw. The hole (46) in the transverse lock rod can be one of a plurality provided on the dual paw for flexibility in connection. The dual paw on the second T-handle latch assembly is attached to the other end transverse lock rod in the same manner. The transverse lock rod connection apparatus can further be provided with first and second pin hooks (48) which can be inserted in the first and second transverse rod pins, respectively, to further secure the transverse lock rod to the dual paws.

With reference to FIG. 4, the transverse lock rod can further be provided with a biasing spring (50). A biasing spring is connected to either T-handle latch assembly by passing one end of the biasing spring through a hole in the internal housing of a T-handle latch assembly (54). The other end of the biasing spring is attached to the transverse lock rod. In the preferred embodiment, the biasing spring is attached to the transverse lock rod by wrapping around a pin (52) on the transverse lock rod, between one fifth and one half the length of the transverse lock rod from the T-handle latch assembly to which the spring is attached, and a pin hook secures the biasing spring pin to the lock rod. The biasing spring can also be attached to the transverse lock rod by wrapping the end of the biasing spring around the pin (52). The biasing spring, thus anchored on the second T-handle latch assembly, draws the transverse lock rod toward said second T-handle latch assembly through the spring tension. The spring acts to return the dual paw to a locked position.

With reference to FIGS. 4 and 7, a Dual T-Lock comprises two T-handle latch assembles provided with the Dual T-Lock Apparatus.

T-handle latch assemblies are provided with the Dual T-Lock Apparatus by removing the latch release assembly of each T-handle latch assembly (see FIG. 5) and placing on the lock shank of each T-handle latch assembly the dual T-handle latch assembly apparatus (FIG. 6) of the present invention. The preferred embodiment of the dual T-handle latch assembly apparatus is placed on the lock shank in the following order, from nearest proximity to the T-handle housing: nut (32); lock washer (33); dualcam (26) with dualcam pin (30) attached thereon; dual paw washer (36); dual paw (20) with bushing (38) wherein the dual paw is placed to engage the dualcam pin within the dualcam pin engaging slot; washer (35); lock washer (33); and nut (32). The two T-handle latch assemblies are then connected to the transverse lock rod (40) with transverse rod pins (44) and pin hooks (48). A biasing spring further connecting the transverse lock rod to one of the T-handle latch assemblies can optionally be provided.

Figure 1:
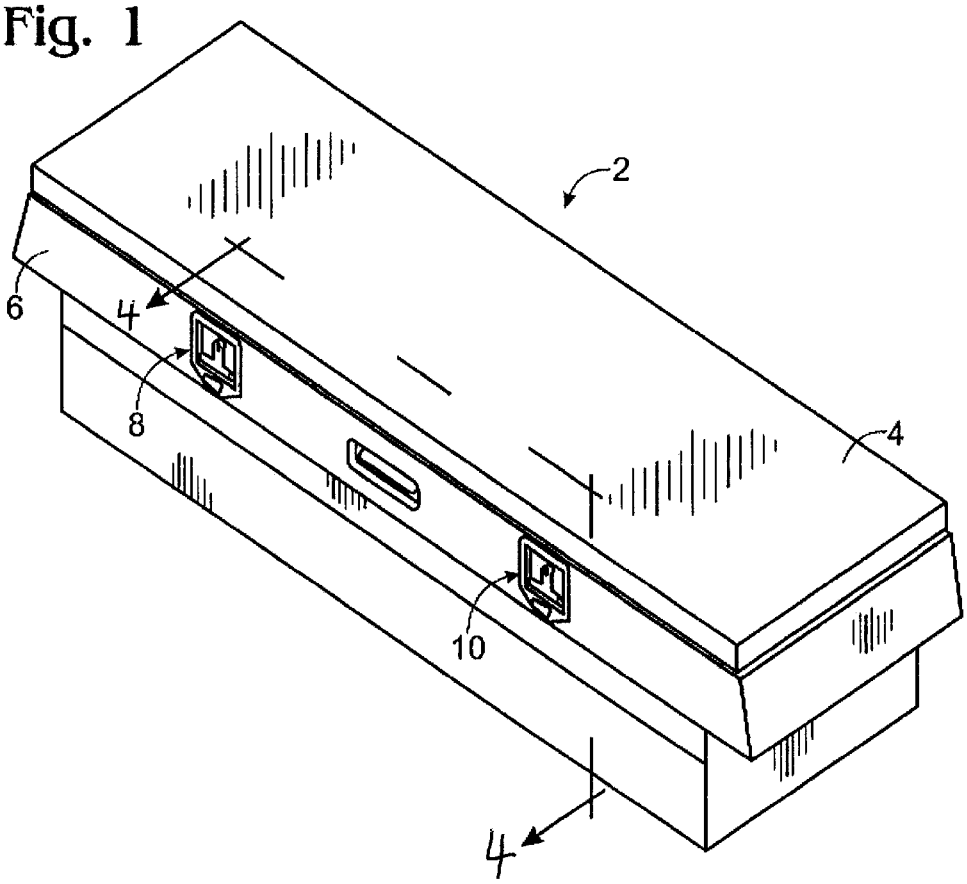
FIG. 1 shows a toolbox provided with an embodiment of the present invention.
Figure 2:
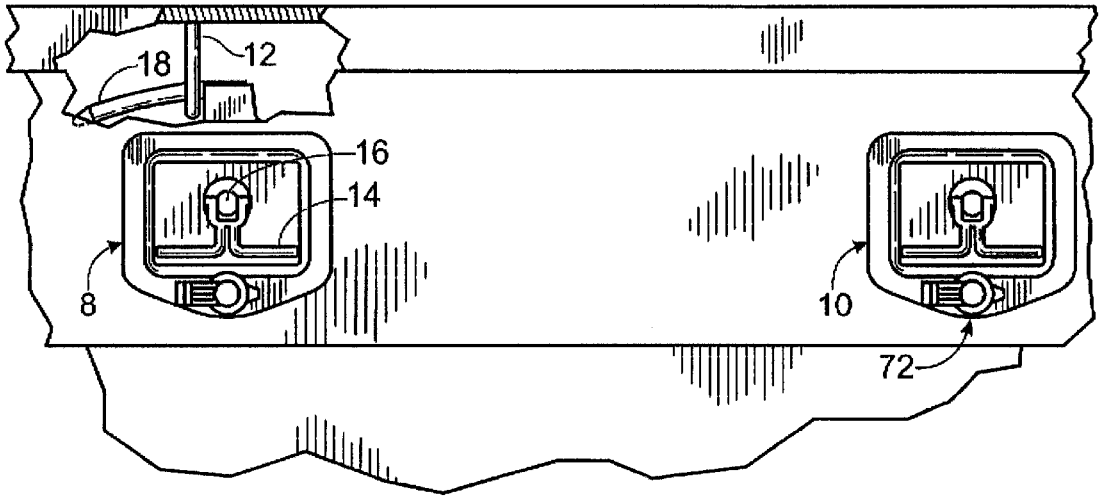
FIG. 2 shows a close up of the upper front of the toolbox and embodiment of the present invention in FIG. 1, with a cut away view.

With reference to FIGS. 1, 2 and 4, toolbox (2) is provided with a Dual T-Lock comprising the Dual T-Lock mounted on a front upper wall (6) of a toolbox with two lock loops (12) mounted on the lid (4) or lids of a toolbox. The two lock loops are mounted corresponding in location to the mounting of the respective T-handle latch assemblies such that the T-handle latch assemblies can engage the lock loops. The T-handle latch assemblies are each configured to secure a toolbox lid in a closed position, and to be released through an unlatching operation to release the toolbox lid to be opened. The T-latch assemblies can be provided with secure locking means (70, 72) such as key actuated locking cylinders.

The Dual T-Lock works with, and does not interfere with, key actuated cylinder-locking apparatus provided with commercially available T-handle latch assemblies. IN the typical commercially available T-handle latch assembly, a key actual cylinder engages with a sliding plate that engages with a receiving plate on the lock shank, preventing the lock shank from being turned by the T-handle. In the present invention, the dual paw is rotatable about the lock shank even when the lock shank is immobile, allowing the dual paw to be driven by the transverse lock rod to open the locked T-handle latch assembly. The present invention likewise is adapted for, and does not interfere with, key-operated locking systems known to be mountable on a T-handle latch assembly, such as those disclosed in U.S. Pat. No. 5,526,660 (Bennett, et al) and U.S. Pat. No. 4,706,478 and/or U.S. Pat. No. 5,526,660 (Bennett, et al). The T-handle latch assemblies with key lock cylinders other than in terms of the structural combination forming the present invention, is not the Applicants' invention.

A truck toolbox mounted with the Dual T-Lock described can be either a single lid toolbox, a split lid toolbox, or a gull wing toolbox. For any toolbox, the T-handle latch assemblies are mounted in the front wall of the toolbox, with lock loops placed on the lid, lids, or wings, to correspond to the mounting of the respective T-handle latch assembly. For any toolbox, the T-handle latch assemblies are mounted such that one T-handle latch assembly is disposed on the driver's side of the toolbox, and one T-handle latch assembly is disposed on the passenger's side of the toolbox.

In operation, the dual action T-handle latch assembly in the closed, locked position is opened by lifting either T-handle from the T-pan and by turning over 90 degrees the T-handle in a clockwise direction. The turning of the T-handle drives the dualcam such that when the T-handle is turned in a clockwise direction, the dualcam is turned in a clockwise direction. The dualcam pin engages the dual paw engaging slot and drives the dual paw rotatably about the lock shank. The dual paw drives the transverse lock rod transversely, driving the dual paw on the second T-handle latch assembly in the clockwise direction.

When either one or both of the T-handle latching assemblies is provided with a keyed locking means, a key is inserted into either of the key-receiving means and then turned. This unlocks the T-handle latch lock shank allowing it to be turned. The T-handle is then lifted and turned which drives the lock shank, in turn driving the dualcam which drives the dual paw, releasing the lock loop and driving the transverse lock rod driving the second T-handle latch assembly and unlatching the second T-handle latch assembly.

It will, of course, be understood that modifications of the invention, in its various aspects, will be apparent to those skilled in the art, some being apparent only after study, others being matters of routine mechanical, chemical and electronic design. No single feature, function or property of the preferred embodiment is essential. Other embodiments are also possible, their specific designs depending upon the particular application. As such, the scope of the invention should not be limited by the particular embodiments herein described but should be defined only by the appended claims and equivalents thereof.

We claim:

1. A Dual T-Lock Apparatus, comprising:

a. a transverse lock rod;

b. a first dual paw connected to one end of said transverse lock rod, wherein the first dual paw is rotatably mounted on a lock shank of a first T-handle latch assembly;

c. a first dualcam movably engageable with said first dual paw through a first dualcam pin, wherein the first dualcam is mounted on the lock shank of the first T-handle latch assembly;

d. a second dual paw connected to said transverse lock rod, wherein the second dual paw is rotatably mounted on a second T-handle latch assembly; and e. a second dualcam movably engageable with said second dual paw through a second dualcam pin, wherein the second dualcam is mounted on the lock shank of the second T-handle latch assembly.

2. The Dual T-Lock Apparatus of claim 1, wherein the first and second dual paws are provided with dualcam pin engaging slots into which the dualcam pins are inserted to movably engage the dual paws.

3. The Dual T-Lock Apparatus of claims 1 or 2, wherein the first and second dual paws are connected to the transverse lock rod with transverse rod pins inserted through the transverse lock rod and the first and second dual paws and wherein pin hooks are inserted through the transverse rod pins.

4. The Dual T-Lock Apparatus of claim 3, wherein the transverse lock rod is further connected to the second T-handle latch assembly by a biasing spring attached to the T-handle latch assembly.

5. The Dual T-Lock Apparatus of claims 1 or 2, wherein the first and second dualcam pins are welded, respectively, to the first and second dualcams.

6. The Dual T-Lock Apparatus of claims 1 or 2, wherein the first and second T-handle latch assemblies are each further provided with first and second nuts and lock washers for securing the apparatus on the T-handle latch assemblies, and a washer and a dual paw washer for reducing rubbing of the dual paws in rotation.

7. The Dual T-Lock Apparatus of claim 1, wherein the first and second dual paws are provided with dualcam pin engaging slots into which the dualcam pins are inserted to movably engage the dual paws, and wherein the first and second dual paws are connected to the transverse lock rod with transverse rod pins inserted through the transverse lock rod and the first and second dual paws, and wherein pin hooks are inserted through the transverse rod pins, and wherein the first and second dualcam pins are welded, respectively, to the first and second dualcams, and wherein the transverse lock rod is further connected to the second T-handle latch assembly by a biasing spring attached to the T-handle latch assembly, and wherein the first and second T-handle latch assemblies are each further provided with first and second nuts and lock washers for securing the apparatus on the T-handle latch assemblies, and a washer and a dual paw washer for reducing rubbing of the dual paws in rotation.

8. A toolbox with T-handle latch assemblies that work in tandem, comprising a toolbox and the apparatus of claims 1, 2, or 7 mounted on the toolbox.

9. A Dual T-Lock, comprising:

a. a transverse lock rod;

b. a first T-handle latch assembly connected to one end of said lock rod; and c. a second T-handle latch assembly attached to said lock rod at the end opposite the first T-handle latch assembly, wherein said second T-handle latch assembly has a second connection to said lock rod, said connection being a biasing spring for biasing said lock rod;

wherein the first and second T-handle latch assemblies are provided with first and second dualpaws, respectively, rotatably mounted on first and second lock shank of said first and second T-handle latch assemblies, respectively, and the transverse lock rod pivotally connects to the first and second dual paws; and wherein the first and second T-handle latch assemblies are further provided with first and second dualcams, respectively, mounted on the first and second lock shanks and the first and second dualcams movably engage the first and second dual paws with first and second dualcam pins affixed to the first and second dualcams, respectively.

10. A toolbox with a Dual T-Lock, comprising a toolbox and the apparatus of claims 9, 11, 12, or 13 mounted on the toolbox.

11. The Dual T-Lock of claim 9, wherein the first and second dual paws are provided with dualcam pin engaging slots into which the dualcam pins are inserted to movably engage the dual paws.

12. The Dual T-Lock of claim 11, wherein the first and second dualcam pins are welded, respectively, to the first and second dualcams.

13. The Dual T-Lock of claim 11, wherein the first and second dual paws are connected to the transverse lock rod with transverse rod pins inserted through the transverse lock rod and the first and second dual paws and wherein pin hooks are inserted through the transverse rod pins.

14. The Dual T-Lock of claims 11, 12, or 13, wherein the transverse lock rod is further connected to the second T-handle latch assembly by a biasing spring attached to the T-handle latch assembly and to the transverse lock rod.

15. A toolbox with a Dual T-Lock, comprising a toolbox and the apparatus of claim 14 mounted on the toolbox.

16. The Dual T-Lock of claim 14, wherein the first and second T-handle latch assemblies are each further provided with first and second nuts and lock washers for securing the apparatus on the T-handle latch assemblies, and a washer and a dual paw washer reducing rubbing of the dual paws in rotation.

17. A toolbox with a Dual T-Lock, comprising a toolbox and the apparatus of claim 16 mounted on the toolbox.

* * * * *